US007021647B2

(12) United States Patent
Restani

(10) Patent No.: US 7,021,647 B2
(45) Date of Patent: Apr. 4, 2006

(54) BOARD FOR GLIDING

(75) Inventor: Eric Restani, Isere (FR)

(73) Assignee: Skis Rossignol S.A., Voiron (FR)

( * ) Notice: Subject to any disclaimer, the term of this patent is extended or adjusted under 35 U.S.C. 154(b) by 0 days.

(21) Appl. No.: 10/659,915

(22) Filed: Sep. 11, 2003

(65) Prior Publication Data

US 2004/0046362 A1 Mar. 11, 2004

Related U.S. Application Data

(62) Division of application No. 09/686,051, filed on Oct. 11, 2000, now abandoned.

(30) Foreign Application Priority Data

Oct. 14, 1999 (FR) ..... 99 13052

(51) Int. Cl.
*A63C 5/07* (2006.01)

(52) U.S. Cl. ..... 280/602; 280/607

(58) Field of Classification Search ..... 280/601, 280/602, 607, 609, 610, 11.14
See application file for complete search history.

(56) References Cited

U.S. PATENT DOCUMENTS

| | | | | |
|---|---|---|---|---|
| 2,377,504 | A * | 6/1945 | Lermont | 280/601 |
| 3,398,968 | A * | 8/1968 | Mutzhas | 280/602 |
| 4,071,264 | A * | 1/1978 | Legrand et al. | 280/610 |
| 4,199,169 | A * | 4/1980 | Guenzel et al. | 280/602 |
| 4,293,142 | A * | 10/1981 | Davignon | 280/610 |
| 4,537,417 | A * | 8/1985 | Hirnbock et al. | 280/602 |
| 4,565,386 | A * | 1/1986 | Crainich | 280/602 |
| 5,002,301 | A * | 3/1991 | Cagneux et al. | 280/602 |
| 5,244,227 | A * | 9/1993 | Lacroix | 280/609 |
| 5,284,357 | A * | 2/1994 | Tinkler | 280/602 |
| 5,292,148 | A * | 3/1994 | Abondance et al. | 280/602 |
| 5,332,252 | A * | 7/1994 | Le Masson et al. | 280/602 |
| 5,393,086 | A * | 2/1995 | Le Masson et al. | 280/602 |
| 5,553,884 | A * | 9/1996 | Abondance | 280/609 |
| 5,671,940 | A * | 9/1997 | Abondance | 280/602 |
| 5,944,335 | A * | 8/1999 | Riepler | 280/602 |
| 6,073,954 | A * | 6/2000 | Guiguet et al. | 280/601 |
| 6,270,108 | B1 * | 8/2001 | Phelipon et al. | 280/602 |
| 6,293,567 | B1 * | 9/2001 | Menges | 280/14.21 |

FOREIGN PATENT DOCUMENTS

| | | | |
|---|---|---|---|
| DE | 29616670 | | 1/1998 |
| FR | 2660385 | A1 * | 10/1991 |
| FR | 2698794 | A1 * | 6/1994 |
| FR | 2779658 | | 12/1999 |

* cited by examiner

*Primary Examiner*—Christopher P. Ellis
*Assistant Examiner*—Christopher Bottorff
(74) *Attorney, Agent, or Firm*—Burr & Brown

(57) ABSTRACT

A board for gliding that has an underfoot zone for receiving the foot or feet of the user that extends toward the front of the board by a tip zone and to the rear of the board by a heel zone. The board further including a lower assembly containing a protective layer and reinforcement. An intermediate core is located between the two assemblies. A plate is located in the underfoot zone that is displaceable in the direction of the lower assembly by foot pressure exerted by the user. A rigid arm is mounted in the board transverse to the core so that one end of the other end bears upon the underside of the plate. Forces exerted by the user on the upper surface of the board are transmitted to the lower surface of the board by the ends of the arm.

2 Claims, 3 Drawing Sheets

BOARD FOR GLIDING

CROSS REFERENCE TO RELATED APPLICATION

This is a divisional application of U.S. Ser. No. 09/686,051, filed Oct. 11, 2000, now abandoned the entirety of which is incorporated herein by reference.

FIELD OF THE INVENTION

The invention relates to the field of sports involving gliding over snow using at least one board, such as downhill skiing, cross-country skiing, snowboarding and derivatives thereof. More specifically, it relates to a novel structure incorporating inner reinforcements acting as stiffener and for improving the transmission of the forces from the skier's feet in the direction of the edges.

In the remainder of the description, the invention will be described more particularly in its application to downhill skiing, but it could be transferred to other types of board without a problem for a person skilled in the art.

PRIOR ART

As is known, a downhill ski is generally regarded as consisting of three zones juxtaposed along its length, namely:

- a first, underfoot zone located in the region where the binding is positioned;
- a tip zone, located in front of the underfoot zone;
- and a heel zone, located to the rear of the underfoot zone.

When the skier exerts forces, particularly when beginning a turn, the mechanical structure of the board means that the pressure exerted on the snow is different from one point to another along the ski.

More specifically, it is observed that the pressure is generally at its maximum in the region of the underfoot zone and, more particularly, right underneath the binding.

The pressure is less, but still exists, in the region of the front and rear contact lines which correspond to the limits of the surface of contact between the sole and the snow.

In traditional structures, it is very generally observed that there are zones in which the pressure is particularly low, located in front of the rear contact line and behind the front contact line.

It is thus appreciated that gripping of the edges in the snow is relatively ineffective in these particular zones.

This lack of grip may be reflected as a difficulty in steering the ski and also in a lack of precision in terms of the path followed.

One of the objectives of the invention is to allow optimum grip over the entire length of the ski in order to improve steering precision.

Moreover, there is currently a trend to widen the tip and heel ends of boards for gliding. In point of fact, the phenomenon of loss of precision is further aggravated on boards with deeper sidecuts.

In order to ensure longitudinal stiffness of the board, it has already been proposed to incorporate longitudinal reinforcements inside the core of the board, as described, for example, in the Applicant's patent No. FR 2 366 034.

Moreover, document FR 2 779 658 presents a means of reinforcing a board for gliding intended to increase the service life of the latter. This particular means consists of a longitudinal blade traversing the core vertically.

Although they make it possible to increase the longitudinal stiffness of the board, such solutions nevertheless do not eliminate the aforesaid zones in which the pressure is markedly less than over the remainder of the board.

The problem which the invention thus proposes to solve is that of the effective transmission of the bearing forces exerted by the skier in the direction of the sole of the board, so that the entire length of the edge is subjected to sufficient pressure to ensure optimum grip in the snow.

SUMMARY OF THE INVENTION

The invention thus relates to a board for gliding having an underfoot zone, intended to receive the foot or feet of the user, extending toward the front via a front zone and to the rear via a rear zone, and the structure of which includes:

- a lower assembly comprising the gliding sole, the edges and an optional lower reinforcement;
- an upper assembly comprising the protective upper layer and an upper reinforcement;
- an intermediate core placed between the lower and upper assemblies.

A board of this type is characterized in that it includes a plate located in the region of the underfoot zone and capable of being displaced in the direction of the lower assembly through the effect of a pressure exerted by the user's foot and at least one longitudinal rigid arm, housed inside the structure of the board, traversing at least most of the thickness of the core, the end of the arm furthermost from the underfoot zone bearing on the lower face of the core, on the lower assembly of the-board, the end of the arm closest to the underfoot zone bearing under the plate, in the vicinity of the user's feet, so that the forces exerted by the user on the upper surface of the board in the region of the underfoot zone of the board are transmitted directly toward the lower surface of the board via the end of the arm oriented in the direction of the lower assembly of the board.

In other words, the invention consists in equipping the board with a rigid element intended to serve as element of transmission from the zone where the binding is fitted as far as in the direction of the zones in which pressure is minimal, on traditional boards.

In other words, the characteristic arm ensures direct mechanical continuity between the board located in the region of the underfoot zone, where the binding is fitted, and the front and/or rear zones of the sole of the board. The arms may be embedded inside the core or, alternatively, entirely traverse the core, thus the upper and lower surfaces thereof.

Advantageously, in practice, each arm includes, at least at one of its ends, a support buffer for distributing the forces transmitted by the arm. In other words, the arm may be equipped with an element for improving the pick-up of the forces exerted by the skier and may also be equipped with an element located at the low end of the arm, for distributing the forces transmitted by this arm over a surface above that of the arm section proper.

In a first embodiment, the board according to the invention may include an arm located to the front of the underfoot zone and oriented in the longitudinal axis of the board, said arm being equipped at its end furthermost from the underfoot zone with a transverse buffer intended to distribute the forces transmitted by the arm over a substantial part of the width of the board.

In other words, in this embodiment, the characteristic arm and buffer have a general T shape, the bar of which rests on the sole or, more generally on the lower assembly, while the foot of the T comes close to the underfoot zone of the ski.

In a variant embodiment, the board may include a second arm of similar geometry located to the rear of the underfoot zone.

In one embodiment, the board may include two substantially parallel arms located to the front of the underfoot zone, each arm being positioned on each side of the ski.

In this embodiment, mechanical transmission takes place in a differentiated manner depending on whether the bearing forces are exerted on the inside or outside edge, which makes the bearing force more effective on the edge in question.

In a variant embodiment, the board may include a second pair of parallel arms, offset transversely and located to the rear of the underfoot zone.

A number of geometries may be adopted, in which the plate is located either above the upper assembly of the board or inside a housing provided for this purpose in the upper assembly of the board.

The plate may also be located either between the upper assembly and the core or, alternatively, inside the core, flush with the top or totally embedded in the core.

In a particular embodiment, the rigid plate may include at least one layer of viscoelastic or elastic material arranged on one of its faces so as to allow a displacement thereof through squashing of the elastic layer.

In a particular embodiment, the arms which are located to the front and to the rear may form part of a single piece extending under the plate.

In this way, the arms form a portal-type piece consisting of two parts, a front part and a rear part, resting on the lower assembly, and of a central part in the form of a bridge on which the rigid plate rests. Under the impulsion force of the skier's feet, the rigid plate is displaced downwards, bearing on the bridge, which has the effect of orienting this force on each of the arms, toward the front and toward the rear.

In another particular embodiment, the two arms located to the front and/or to the rear may intersect, in order to stiffen the board in terms of torsion in three localized zones.

In particular embodiments, the arms may be covered with a layer of elastic or viscoelastic material which gives them a certain ability to be displaced with respect to the core they traverse.

The arms may also be housed inside sheaths in order to allow sliding.

In practice, the arms may have an axis of revolution which gives them isotropic mechanical properties which are identical in any direction oriented perpendicularly to the direction of the arm.

Conversely, in other embodiments, the arms have anisotropic mechanical properties conferred by a section whose geometry favors mechanical strength in a particular direction.

Thus, in the case of a blade of rectangular section, the larger side of which is perpendicular to the sole of the board, the arm has considerable strength to withstand the forces transmitted perpendicularly to the gliding sole, but does not adversely effect lateral deformation of the board since it exerts no marked resistance in these directions parallel to the gliding sole and perpendicular to the longitudinal axis of the board.

In practice, the arms may be made from very varied materials, such as metallic tubes made from aluminum alloy or the like, rigid steel rods or, alternatively, cords of glass or carbon fibers, profiled sections made from metal or from a composite material or, alternatively, from glass, carbon or aramide fibers.

BRIEF DESCRIPTION OF THE FIGURES

The way in which the invention is embodied and the advantages arising therefrom will become clearly apparent from the description of the embodiments which follow, with reference to the appended figures in which.

EMBODIMENT OF THE INVENTION

As already stated, the invention relates to a board for gliding which has, in its internal structure, arms which allow the transmission of forces from the underfoot zone in the direction of the front and/or rear zones in the region of the sole.

Figure 1:
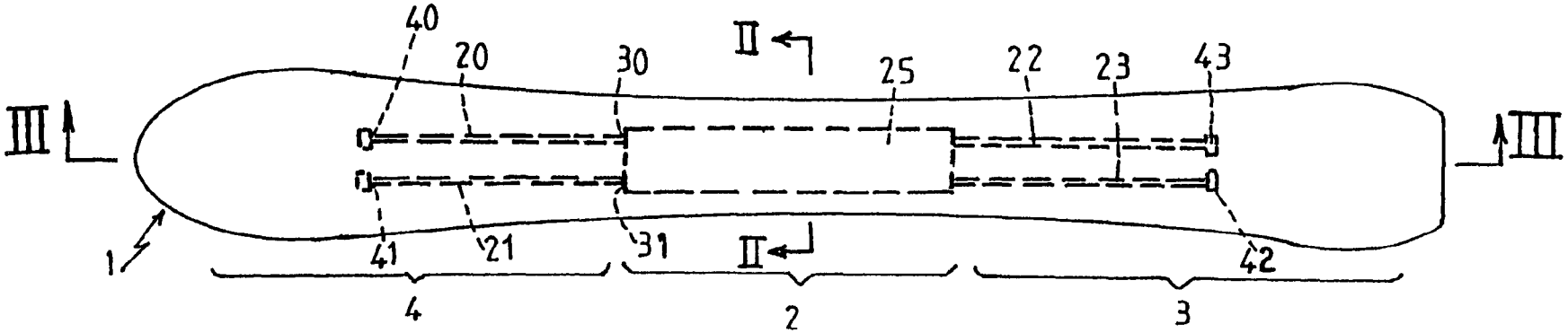
FIG. 1 is a top view of a ski according to the invention, in which the characteristic elements are shown in dotted lines.

More specifically, and as illustrated in FIG. 1, a ski (1) includes, in a known manner, an underfoot zone (2) which corresponds substantially to the narrowest zone of the ski.

This underfoot zone (2) extends rearward via a heel zone (3) and forward via a tip zone (4).

Figure 2:
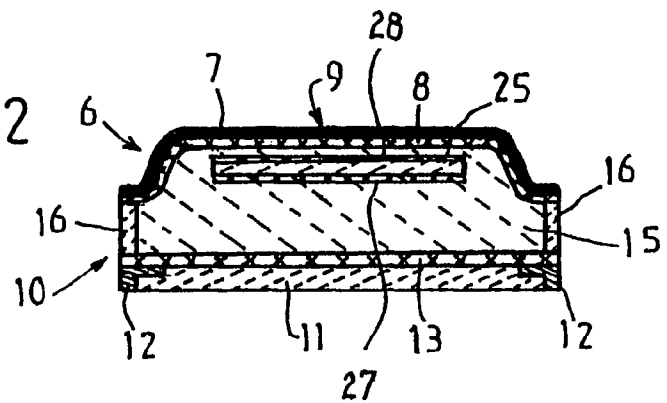
FIG. 2 is a view in transverse section in the region of the underfoot zone II—II of the ski of FIG. 1.

A board of this type, as illustrated in FIG. 2, comprises, in a known manner, an upper assembly (6) consisting of the upper protective layer (7) which forms the topsheet and also of an upper reinforcement (8) which is generally made from coated glass-fiber fabric.

A ski includes, also in a known manner, a lower assembly (10) which includes the gliding sole (11) proper, forming the lower face of the ski and bordered laterally by metal edges (12). This lower assembly (10) optionally includes a lower reinforcement (13) which is usually also made from coated glass-fiber fabric.

In a known manner, the ski comprises, between the upper assembly (6) and the lower assembly (10), a core (15) made from injected polyurethane bordered laterally by sides (16) which may be fitted to all or part of the height of the board.

According to the invention, the internal structure of the board comprises one or more arms (20–23) for transmitting the forces exerted by the skier from the upper face (9) of the ski in the underfoot region (2) as far as the sole (11) of the ski, in the region of the tip and/or heel zones.

More specifically, and in a non-limiting illustrated form, the ski includes two pairs (20, 21; 22, 23) of arms and also an inner plate (25). More specifically, a first pair of two parallel arms (20, 21) is arranged in front of the underfoot zone (2). Each of the arms (20, 21) of the front pair has its rear end (30, 31) in contact with the inner plate (25).

In the embodiment illustrated, the inner plate (25) is covered on its upper and lower faces with an elastic strip (27, 28) intended to allow a slight relative movement of the plate (25) in the vertical direction.

These elastic strips (27, 28) have a thickness of from 0.1 to 3 millimeters.

In order to produce the board illustrated in FIG. 3, in a first stage a core is produced in the following manner: the inner plate (25) is placed in the mold for manufacturing the core with the various arms (20, 21; 22, 23). Then, after this mold has been closed, polyurethane is injected in order to form the core (15), thus including, embedded in its structure, the plate (25) and the arms (20–23). This core is then placed, conventionally, in the mold for manufacturing the board, between the lower (10) and upper (6) assemblies.

In another embodiment, the elastic strip (27) arranged above the inner plate (25) comes directly into contact with the upper reinforcement layer (8), so as to be able to receive the forces exerted by the skier through the single thickness of the upper assembly (6).

The two arms (20, 21) of the front pair are equipped, at their front ends, with buffer elements or shoes (40, 41) for distributing the forces transmitted by the arms (20, 21) over a surface area which is considerably greater than the section of the arms (20, 21), so as to prevent these arms (20, 21) damaging the lower reinforcement element (13) of the lower assembly (10).

In this way, it is possible easily and effectively to secure the buffers (40, 41) to the sole (11) or to the lower reinforcement (13) in order to ensure good transmission of these forces.

In practice, the buffers or the front ends (40, 41) of the front arms (20, 21) are arranged approximately 100 millimeters from the front contact line, in the zone where the load is minimal on a conventional board.

As illustrated in FIG. 1, the board according to the invention may be equipped with a second pair of arms (22, 23) arranged to the rear of the underfoot zone (2) and also interacting with the inner plate (25) via their ends (32, 33).

The precise orientation of the arms (20–23) may be adapted to a greater or lesser degree as a function of the geometry of the ski proper.

Thus, in certain particular cases, it may be advantageous for the two arms to lie precisely in line with the edges (12) and to have a slightly divergent geometry.

Figure 3:
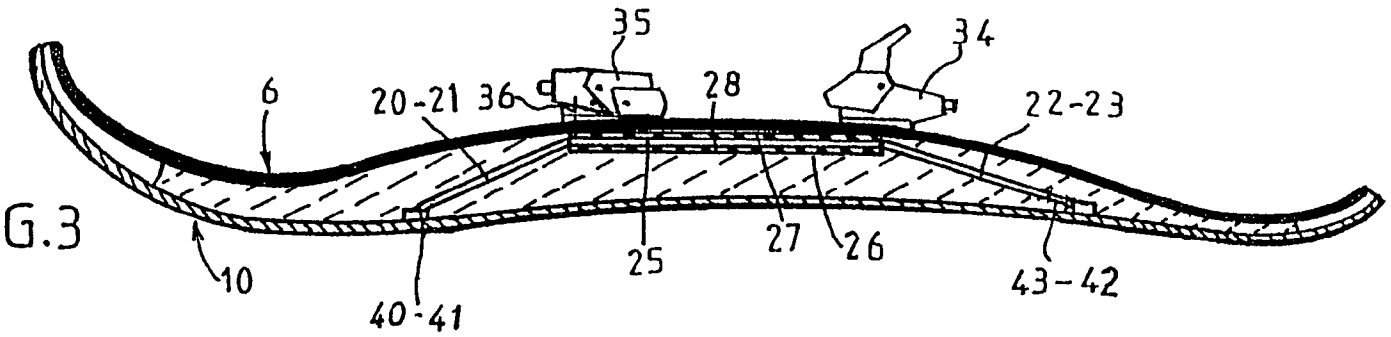
FIG. 3 is a sectional view in reference plane III—III of FIG. 1.

As illustrated in FIG. 3, the inner plate (25) housed at the top of the core (15) receives, through the upper assembly (6), screws (36) for fitting the binding.

In this manner, when the skier exerts forces vertically, the parts of the binding (34, 35) transmit these forces via the fitting screws (36) over the characteristic inner plate (25). These forces are then transmitted by the characteristic arms (20–23) as far as close to the edges (12).

In this way, the pressure exerted in the region of the edges (12) is relatively uniform and, in any case, relatively distributed over the length of the edge, which allows good holding in the turn and steering precision.

Figure 4:
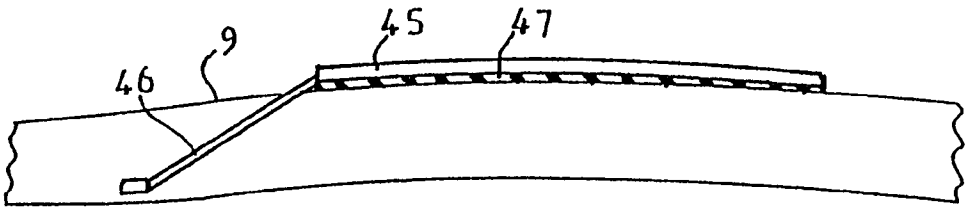
FIG. 4 is a diagrammatic detailed view illustrating a variant embodiment of the arrangement of the plate according to the invention.

In a different embodiment, illustrated in FIG. 4, the plate (45) receiving the forces from the skier is above the upper face (9) of the ski. In this case, the characteristic arm (46) traverses the upper assembly (6) of the ski in order to come into contact with the plate (45).

The binding is then fitted directly onto the characteristic plate (45) which is visible. This plate rests on an elastic strip (47) which is itself in contact with the upper face (9) of the ski. The ability of this elastic strip (47) to deform allows the plate (45) to be displaced in a vertical direction and to exert a force on the characteristic arm (46).

Figure 5:
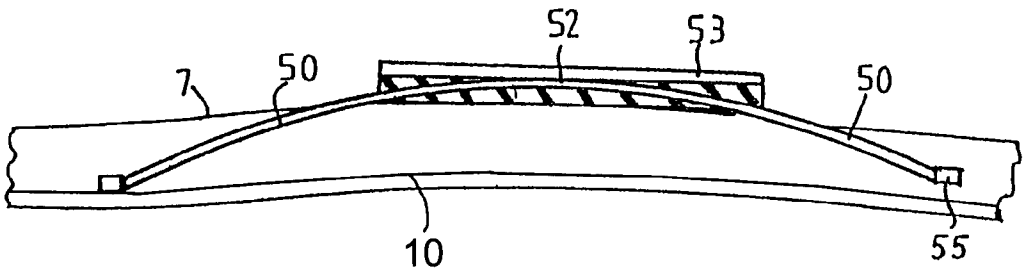
FIG. 5 is a diagrammatic detailed view illustrating a further variant embodiment of the arrangement of the plate.

In a variant embodiment illustrated in FIG. 5, the plate includes a characteristic pair of arms (50), arranged on either side of the board, each extending from the front to the rear of the latter and forming a bridge (52) in the region of the plate (53). The bearing forces on the plate (53) are then broken down into two forces directed toward the ends and distributed by the buffers at the front (54) and at the rear (55).

In this case, the forces are thus transmitted more directly in the region of the front and rear zones simultaneously.

Figure 6:
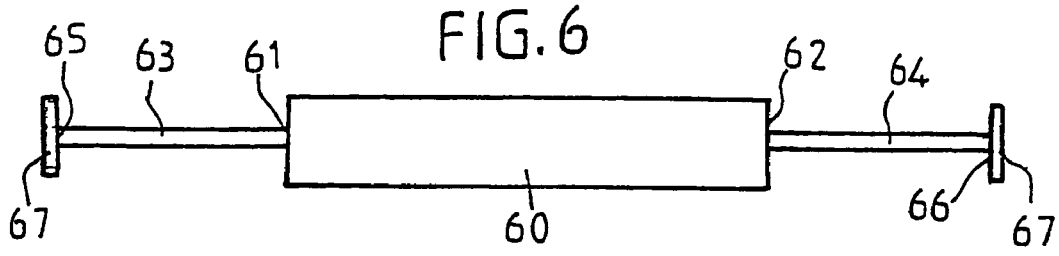
FIGS. 6 to 8 are diagrammatic top views of assemblies consisting of plates and reinforcement arms according to the invention.
Figure 7:
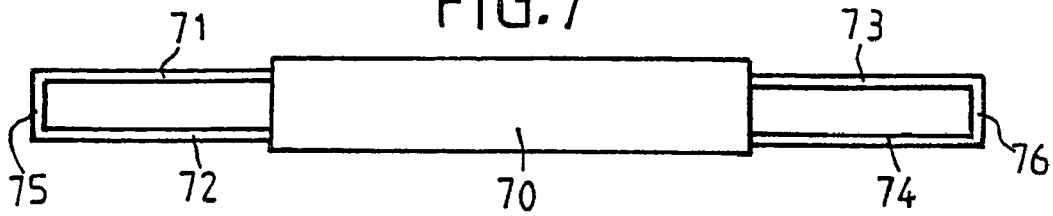
Figure 8:
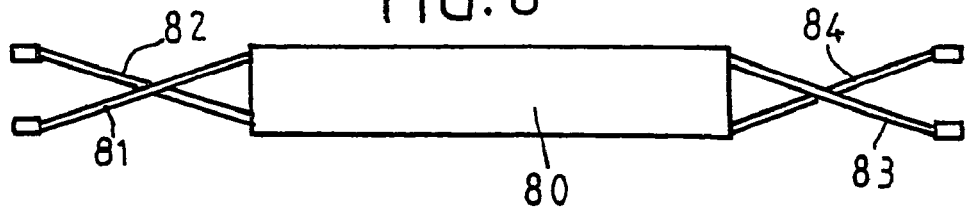

FIGS. 6 to 8 illustrate variant embodiments of plates and characteristic arms. Thus, the plate (60) in FIG. 6 interacts in the region of its front (61) and rear (62) ends with a central arm (63, 64) arranged in the longitudinal axis of the ski and which includes, at its front end (65) (or rear end (66) in the case of the rear arm), a transverse bar (67) for exerting a bearing force over practically the entire width of the sole in the region where this bar is arranged.

In this case, the pressure exerted by the edges is practically identical on both the outside and inside edges.

FIG. 7 illustrates an embodiment in which the ski includes two pairs of arms (71, 72, 73, 74) arranged to the front and to the rear of the characteristic plate (70). In each pair, the arms are joined, in the region of their end which is opposite the plate (70), by a transverse bar (75, 76) which makes it possible, like the bar (67) in FIG. 6, to provide a bearing force over a substantial part of the width of the sole.

Quite obviously, in the embodiments illustrated in FIGS. 6 and 7, the front and rear arms may be connected in order to form a single arm extending underneath the plate.

It is also possible to mix the various embodiments illustrated in these two figures.

FIG. 8 illustrates another embodiment in which the board includes two pairs of arms (81–84) located to the front and to the rear of the plate (80). Within each pair, the arms are arranged in an intersecting manner so as to stiffen the front and rear zones of the board in terms of torsion.

This embodiment is more particularly suited to very wide boards for gliding, the structure of which is insufficiently rigid in terms of torsion. In this case, the intersecting arrangement of the arms allows, more particularly, reinforcement of the stiffeners in terms of torsion.

Figure 9:
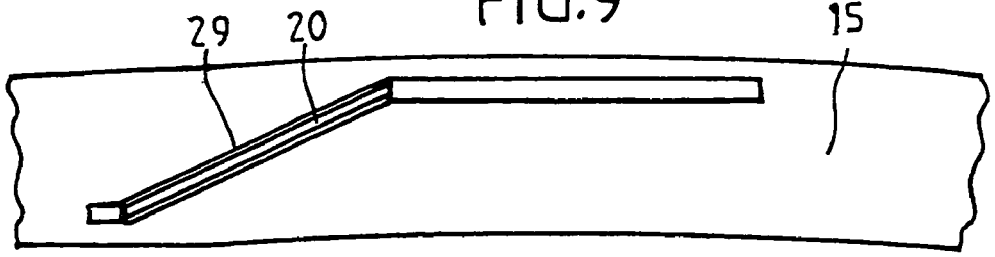
FIG. 9 is a diagrammatic detailed view of an arm according to the invention which has the ability to slide with respect to the core.

According to a characteristic of the invention, and as illustrated in FIG. 9, in order to facilitate the displacement of the arm inside the structure of the core (15) the arm (20) may be arranged inside a tube (29) in which it is able to slide, so as to limit the friction between the arm (20) proper and the structure of the core (15).

The arm (20) may also be coated with a plastic material forming a sheath and capable of being deformed when there is slight displacement of the arm inside the core. This material may be an elastomeric adhesive.

As already specified, the invention also applies to the structure of snowboards. In this case, the snowboard includes two plate/arm assemblies, the arms being oriented in a slightly divergent manner, in the direction of the side edges.

It emerges from the aforesaid that the board structure according to the invention has a number of advantages and, in particular, is able to distribute the pressure exerted by the skier over an appreciable length of the edge, doing so in a relatively uniform manner, or, alternatively, it provides localized reinforcement of this board.

A distribution of this type allows an improved line in the turn and more precise steering of the board.

What is claimed is:

1. A board for gliding having a central underfoot zone for receiving the foot of a user, a front zone extending from the underfoot zone to a front tip of said board, a rear zone extending the underfoot zone to a rear tip of said board said board including;

a lower assembly comprising a gliding sole and edges;

an upper assembly comprising a protective upper layer and an upper reinforcement layer;

an intermediate core placed between the lower and upper assemblies;

a plate mounted in the underfoot zone above the upper assembly of the board, said plate having at least one layer of elastic or viscoelastic material over at least one of its faces and being capable of being displaced in the direction toward the lower assembly through the effort of pressure exerted by the user's foot; and at least one longitudinal rigid arm extending into said at least one layer of said plate downwardly and forwardly from said underfoot zone through the upper assembly, wherein the force exerted by the user's foot is transmitted from the plate forwardly and downwardly to the lower assembly of the board.

2. A board according to claim 1, including at least one longitudinal rigid arm extending downwardly and rearwardly from said underfoot zone.

* * * * *